US006185772B1

(12) United States Patent
Bates

(10) Patent No.: US 6,185,772 B1
(45) Date of Patent: Feb. 13, 2001

(54) BELT WITH BOTTLE OPENER

(76) Inventor: Thomas P. Bates, 54 Main St., East Haddam, CT (US) 06423

( * ) Notice: Under 35 U.S.C. 154(b), the term of this patent shall be extended for 0 days.

(21) Appl. No.: 09/295,151

(22) Filed: Apr. 20, 1999

(51) Int. Cl.[7] ..... B67B 7/00
(52) U.S. Cl. ..... 7/151; 81/3.55
(58) Field of Search ..... 7/151; 81/3.55, 81/3.57; 224/904, 163; 24/197

(56) References Cited

U.S. PATENT DOCUMENTS 1,697,833 * 1/1929 Lane .
2,470,606 * 5/1949 Dennison .
4,135,267 * 1/1979 McKinney, Sr. et al. .
4,384,390 * 5/1983 Hayakaw ..... a .

* cited by examiner

*Primary Examiner*—D. S. Meislin
(74) *Attorney, Agent, or Firm*—DeLio & Peterson, LLC

(57) ABSTRACT

A belt with a fastener wherein one ring of the fastener is adapted for use as a bottle opener. In a preferred embodiment, the fastener comprises a first ring and a second ring, the first ring having a nub and being attached to a front surface of the strip of material, wherein the first ring is adapted to open bottles by grasping a portion of a bottle cap with the ring and applying upward pressure under the bottle cap with the nub. To fasten the belt, the second end of the strip is adapted to be threaded through the second and first rings and re-threaded through the second ring. In a another preferred embodiment, the fastener may further include a third ring such that the second end of the strip is adapted to be threaded through the third, second and first rings and re-threaded through the second and third ring.

15 Claims, 2 Drawing Sheets

BELT WITH BOTTLE OPENER

Background Of The Invention

1. Field of the Invention

The present invention relates to a belt with a bottle opener as part of the fastener.

2. Description of Related Art

Belts having a variety of uses are known in the art. Typically, belts having a utility other than merely as a clothing accessory are bulky and comprise of a multiple number of appendages off the belt itself. The average person would have little use for multiple appendages and would only need one or two small tools attached to the belt. A bottle opener is one such tool which comes in handy when hiking or at a ball game. However, the bottle opener is too bulky for a pocket or when hanging off a belt.

Bearing in mind the problems and deficiencies of the prior art, it is therefore an object of the present invention to provide a streamlined belt having a convenient bottle opener discreetly attached.

Still other objects and advantages of the invention will in part be obvious and will in part be apparent from the specification.

SUMMARY OF THE INVENTION

The present invention is directed, in a first aspect, to a belt comprising a strip of material having a first end and a second end; and a fastener attached to the first end of the strip of material, the fastener comprising a first ring and a second ring, the first ring having a nub and being swivelly attached to a front surface of the strip of material, wherein the first ring is adapted to open bottles by grasping a portion of a bottle cap with the ring and applying upward pressure under the bottle cap with the nub. To fasten the belt, the second end of the strip is adapted to be threaded through the second and first rings and re-threaded through the second ring.

Preferably, the fastener may further include a third ring such that the second end of the strip is adapted to be threaded through the third, second and first rings and re-threaded through the second and third ring. An alternative embodiment method of fastening the belt would be to thread the second end through the first, second and third rings and rethread it through the second ring. In the three ring embodiment, the first ring is attached to the front surface of the strip of material with a twistable swivel hinge such that the first ring is adapted to be swiveled to a position along the plane of the front surface of the strip and lifted to a position perpendicular to the front surface of the strip.

In another aspect, the present invention is directed to a belt comprising a strip of material having a first end and a second end; and a fastener attached to the first end of the strip, the fastener comprising a first ring, a second ring and a third ring, the first ring having a nub and being swivelly attached to a front surface of the strip of material, wherein the first ring is adapted to open bottles by grasping a portion of a bottle cap with the ring and applying upward pressure under the bottle cap with the nub. Preferably, the second end of the strip is adapted to be threaded through the first, second and third rings and re-threaded through the second and third ring.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
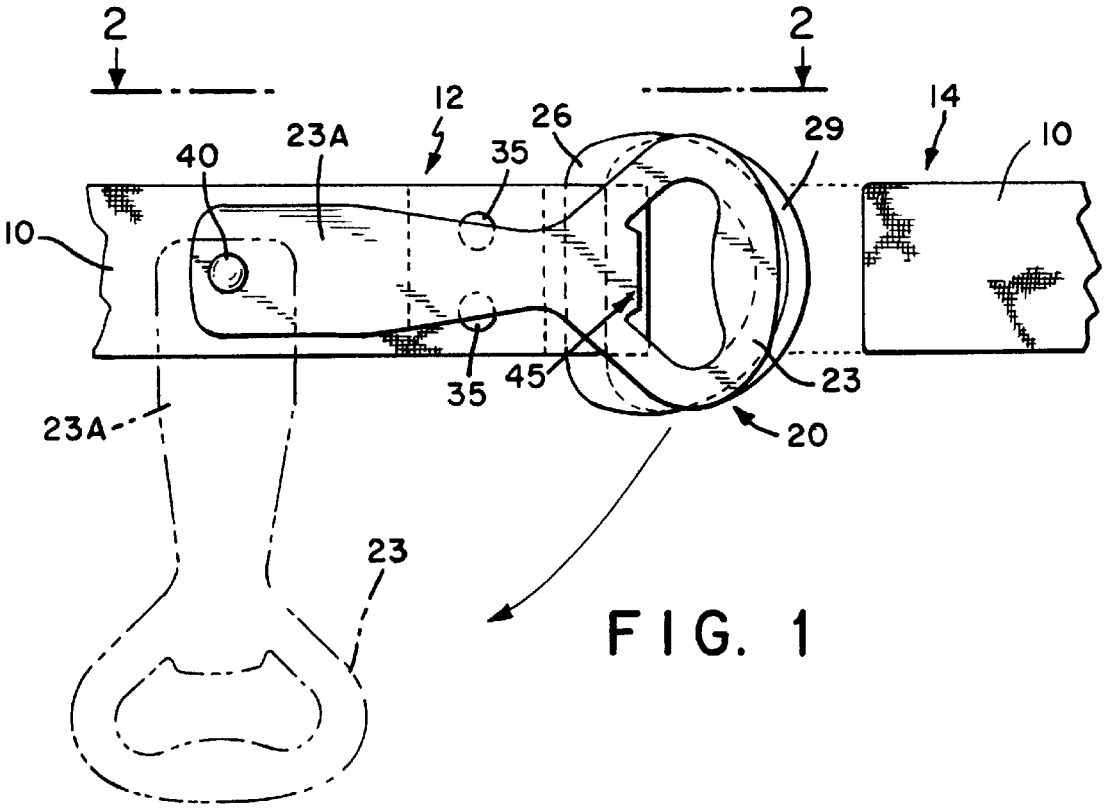
FIG. 1 is a top plan view of a preferred embodiment of the present invention prior to engaging the fastener.
Figure 2:
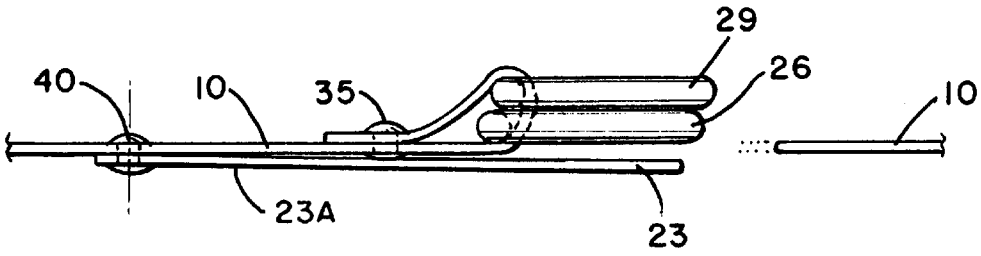
FIG. 2 is a side view of a preferred embodiment of the present invention prior to engaging the fastener.

In describing the preferred embodiment of the present invention, reference will be made herein to FIGS. 1–5 of the drawings in which like numerals refer to like features of the invention. Features of the invention are not necessarily shown to scale in the drawings.

A preferred embodiment of the present invention is illustrated in FIG. 1. The belt of the present invention comprises a strip of material 10 having a first end 12 and a second end 14. The material may comprise a durable yet pliable woven synthetic or any type of flexible, preferably waterproof, material such as nylon. Attached to the first end 12 of strip 10 is a fastener 20 comprising a first ring 23, a second ring 26 and a third ring 29. Second ring 26 and third ring 29 are fixedly attached to strip 10 by looping a small portion of the strip material through both rings and securing the looped portion to the body of strip 10 with fasteners such as rivets 35.

First ring 23 is adapted to be a bottle opener having a handle portion 23A which is movable attached to a front surface of strip 10 with an attachment means 40. Attachment means 40 preferably allows first ring 23 to rotate about an axis of the attachment means (as shown in phantom lines in FIG. 1) while also capable of resting first ring 23 flat against strip 10 and aligned with second ring 26 and third ring 29. Preferably, the attachment means comprises a rivet 40 (as shown) or other attachment means may be contemplated which allow further spatial manipulation of first ring 23.

Figure 5:
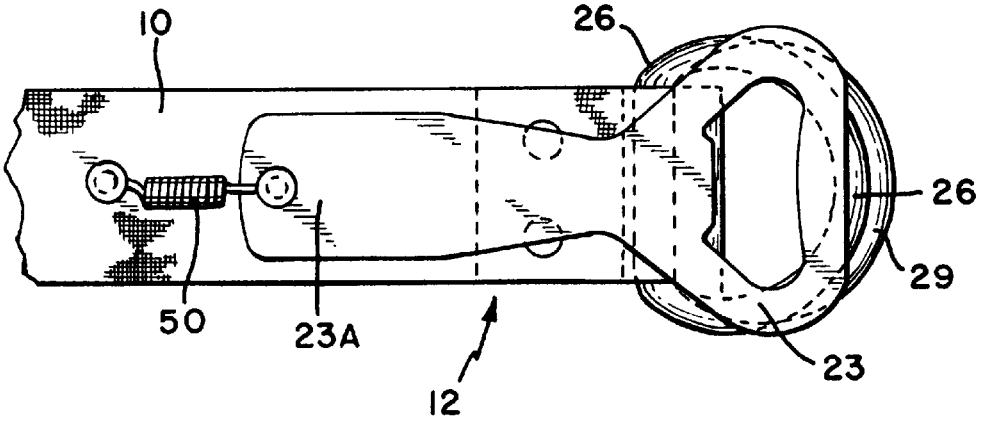
FIG. 5 is a perspective view of a preferred embodiment of the present invention.

Although other attachment means may be contemplated, an example is shown in FIG. 5 as a small spring 50. Thus, upon disengaging first ring 23, an operator would be able to easily position first ring 23 to use first ring 23 as a bottle opener without substantially removing the belt. An alternative embodiment for attaching the first ring 23 to the strip 10 may comprise a hinge means which would allow rotational and translational movement of first ring 23. First ring 23 may be rotated along from the plane of strip 10 and raised or lowered to a position substantially perpendicular to the plane of strip 10.

First ring 23 has a portion of the ring adjacent to handle portion 23A which will engage the underside edge of a bottle cap on a bottle to provide the leverage needed such that by pulling up on handle portion 23A, the bottle cap is disengaged from the bottle. Preferably, the portion of the ring which engages the edge of the bottle cap has a flattened edge which may remain flush or extend into nub 45. Nub 45 would rest under the edge of a bottle cap to provide a leverage site when removing the bottle cap.

Figure 3:
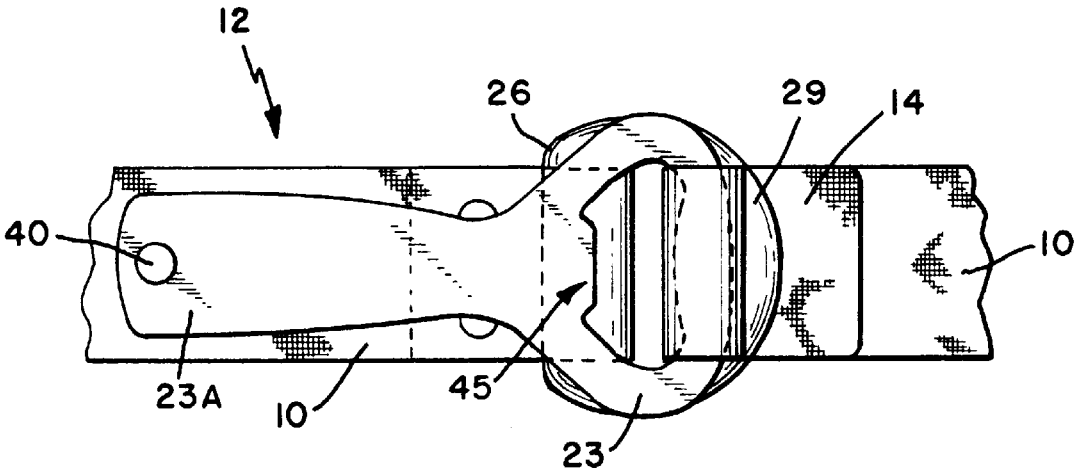
FIG. 3 is a top plan view of a preferred embodiment of the present invention when the fastener is engaged.
Figure 4:
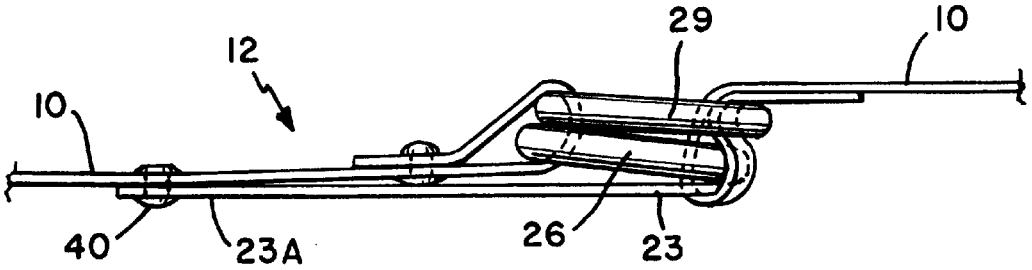
FIG. 4 is a side view of a preferred embodiment of the present invention when the fastener is engaged.

FIGS. 3 and 4 illustrate the belt of the present invention when fastener 20 is engaged to connect the first 12 and second 14 ends of strip 10 as it would be buckled on a person wearing the belt. The second end 14 of strip 10 is threaded through third ring 29, second ring 26 and first ring 23 then re-threaded through second ring 26 and third ring 29. Second end 14 may be pulled to a desired tightness such that the rings are held together. The second 26 and third 29 rings may also comprise the fastener with first ring 23 swung away from the second end of strip 10 and lying substantially flat against strip 10.

Alternatively, the belt may be made with only two rings such that the second end of strip 10 is threaded through second ring 26 and first ring 23 then re-threaded through second ring 26 and pulled to a desired tightness about the wearer.

The present invention achieves the objects recited above. The belt of the present invention provides a streamlined belt with a bottle opener as a portion of the fastener in either a two or three ring buckle. The bottle opener is discreetly attached to the belt and may lie flat along the strip of the belt material when the fastener comprises a three ring buckle. An alternative attachment means may be provided to allow further spatial manipulation of the bottle opener for ease of use.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A belt comprising a strip of material having a first strip end and a second strip end; and a fastener attached to said first end of said strip of material, said fastener comprising a first ring bottle opener portion and a second ring portion, said first ring bottle opener portion having an inward nub therein and being movably attached to a front surface of said strip of material, wherein said first ring bottle opener portion is adapted to open bottles by grasping a portion of a bottle cap with said ring having said inward nub and applying upward pressure on the bottle opener portion under the bottle cap.

2. The belt of claim 1 wherein said second strip end is adapted to be threaded through said first bottle opener portion and second ring portion of said fastener and re-threaded through said second ring portion of said fastener.

3. The belt of claim 1 wherein said first ring bottle opener portion comprises an elongated member with a first end having an opening with the inward nub and a second end being a handle, said first bottle opener portion being movably attached to the front surface of said strip of material at said second end.

4. The belt of claim 1 wherein said first bottle opener portion of said fastener is attached to the front surface of said strip of material by an attachment means adapted to attach said bottle opener portion.

5. The belt of claim 4 wherein said attachment means comprises a rivet.

6. The belt of claim 4 wherein said attachment means comprises a spring.

7. A belt comprising a strip of material having a first strip end and a second strip end;

a fastener attached to said first strip end of said strip of material, said fastener comprising a first ring, a second ring and a third ring, said first ring having an inward nub and being movably attached to a front surface of said strip of material, wherein said first ring is adapted to open bottles by grasping a portion of a bottle cap with said first ring having the inward nub and applying upward pressure under the bottle cap with said first ring.

8. The belt of claim 7 wherein fastening of said fastener is formed by threading said second strip end through said first, second and third rings and re-threading said second strip end through said second and third rings.

9. The belt of claim 7 wherein fastening of said fastener is formed by threading said second strip end through said first, second, and third rings and re-threading said second strip end through said third ring.

10. The belt of claim 7 wherein said first ring adapted to open bottles is attached to the front surface of said strip of material by an attachment means adapted to attach said first ring to the front surface of the strip of material.

11. The belt of claim 10 wherein said attachment means comprises a spring.

12. The belt of claim 10 wherein said attachment means comprises a rivet.

13. The belt of claim 7 wherein said first ring adapted to open bottles comprises an elongated member with a first end being a handle and a second end having an opening with the inward nub, said first ring being movably attached to the strip of material at said first end.

14. The belt of claim 7 wherein said second and third rings are attached to said strip of material by looping a portion of said strip of material through said second and third rings and securing said loop to the strip of material using fasteners.

15. The belt of claim 7 wherein said first ring opens said bottle cap without substantially removing said belt.

* * * * *